US009281569B2

(12) United States Patent
Taylor et al.

(10) Patent No.: US 9,281,569 B2
(45) Date of Patent: Mar. 8, 2016

(54) DEPLOYABLE REFLECTOR

(75) Inventors: Robert Taylor, Superior, CO (US); Dana Turse, Broomfield, CO (US); Philip N. Keller, Berthound, CO (US); Larry Adams, Thronton, CO (US)

(73) Assignee: COMPOSITE TECHNOLOGY DEVELOPMENT, INC., Lafayette, CO (US)

( * ) Notice: Subject to any disclaimer, the term of this patent is extended or adjusted under 35 U.S.C. 154(b) by 360 days.

(21) Appl. No.: 13/586,591

(22) Filed: Aug. 15, 2012

(65) Prior Publication Data

US 2013/0207880 A1 Aug. 15, 2013

Related U.S. Application Data

(63) Continuation-in-part of application No. 12/361,700, filed on Jan. 29, 2009, now Pat. No. 8,259,033.

(51) Int. Cl.

| | |
|---|---|
| ***H01Q 15/20*** | (2006.01) |
| ***H01Q 1/28*** | (2006.01) |
| ***H01Q 15/16*** | (2006.01) |
| ***H01Q 19/13*** | (2006.01) |

(52) U.S. Cl.

CPC ..... *H01Q 15/20* (2013.01); *H01Q 1/288* (2013.01); *H01Q 15/161* (2013.01); *H01Q 15/162* (2013.01); *H01Q 19/132* (2013.01)

(58) Field of Classification Search

CPC ..... H01Q 15/161–15/163; H01Q 15/20
USPC ..... 343/880–882, 915
See application file for complete search history.

(56) References Cited

U.S. PATENT DOCUMENTS

| | | | |
|---|---|---|---|
| 3,165,751 | A | 1/1965 | Clark |
| 3,385,397 | A | 5/1968 | Robinsky, et at |
| 3,406,404 | A | 10/1968 | Maier |
| 3,473,758 | A | 10/1969 | Valentijn |
| 3,477,662 | A | 11/1969 | Anderson |
| 3,510,086 | A | 5/1970 | Arbeitlang et al. |
| 3,735,942 | A | 5/1973 | Palz |
| 3,735,943 | A | 5/1973 | Fayet |
| 3,817,481 | A | 6/1974 | Berks et al. |
| 3,819,417 | A | 6/1974 | Haynos |
| 3,863,870 | A | 2/1975 | Andrews et al. |
| 3,978,490 | A | 8/1976 | Fletcher et al. |
| 4,030,103 | A | 6/1977 | Campbell |

(Continued)

FOREIGN PATENT DOCUMENTS

| | | | |
|---|---|---|---|
| EP | 0534110 | A1 | 3/1993 |
| JP | 2003306199 | A | 10/2003 |

(Continued)

OTHER PUBLICATIONS

Antenna Theory: a Review, Balanis, Proc. IEEE vol. 80 No. 1 Jan. 1992.*

(Continued)

*Primary Examiner* — Sue A Purvis
*Assistant Examiner* — Amal Patel
(74) *Attorney, Agent, or Firm* — Maschoff Brennan

(57) ABSTRACT

A reflector is provided according to various embodiments. The reflector may include a backing structure having various configurations. The backing structure, for example, can comprise a plurality of trusses, flexible couplings, stiffeners, and crossbeams in any number of arrangements.

12 Claims, 13 Drawing Sheets

(56) References Cited

U.S. PATENT DOCUMENTS

| | | | | |
|---|---|---|---|---|
| 4,133,501 | A | 1/1979 | Pentlicki | |
| 4,475,323 | A | 10/1984 | Schwartzberg et al. | |
| 4,613,870 | A | 9/1986 | Stonier | |
| 4,636,579 | A | 1/1987 | Hanak et al. | |
| 4,646,102 | A | 2/1987 | Akaeda et al. | |
| 4,713,492 | A | 12/1987 | Hanak | |
| 4,727,932 | A | 3/1988 | Mahefkey | |
| 4,747,567 | A | 5/1988 | Johnson et al. | |
| 4,787,580 | A | 11/1988 | Ganssle | |
| 4,926,181 | A | 5/1990 | Stumm | |
| 5,296,044 | A | 3/1994 | Harvey et al. | |
| 5,446,474 | A | 8/1995 | Wade et al. | |
| 5,487,791 | A | 1/1996 | Everman et al. | |
| 5,488,383 | A | 1/1996 | Friedman et al. | |
| 5,520,747 | A | 5/1996 | Marks | |
| 5,574,472 | A | 11/1996 | Robinson | |
| 5,644,322 | A | 7/1997 | Hayes et al. | |
| 5,680,145 | A | 10/1997 | Thomson et al. | |
| 5,700,337 | A | 12/1997 | Jacobs et al. | |
| 5,720,452 | A | 2/1998 | Mutschler, Jr. | |
| 5,785,280 | A | 7/1998 | Baghdasarian | |
| 5,787,671 | A | 8/1998 | Meguro et al. | |
| 5,833,176 | A | 11/1998 | Rubin et al. | |
| 5,857,648 | A | 1/1999 | Dailey et al. | |
| 5,864,324 | A | 1/1999 | Acker et al. | |
| 5,927,654 | A | 7/1999 | Foley et al. | |
| 5,968,641 | A | 10/1999 | Lewis | |
| 5,990,851 | A | 11/1999 | Henderson et al. | |
| 6,017,002 | A | 1/2000 | Burke et al. | |
| 6,104,358 | A | 8/2000 | Parker et al. | |
| 6,137,454 | A | 10/2000 | Peck | |
| 6,208,317 | B1 | 3/2001 | Taylor et al. | |
| 6,225,965 | B1 | 5/2001 | Gilger et al. | |
| 6,228,441 | B1 | 5/2001 | Suzuki et al. | |
| 6,243,053 | B1 | 6/2001 | Shtarkman | |
| 6,278,416 | B1 | 8/2001 | Harless | |
| 6,313,811 | B1 | 11/2001 | Harless | |
| 6,343,442 | B1 | 2/2002 | Marks | |
| 6,344,835 | B1 | 2/2002 | Allen et al. | |
| 6,353,421 | B1 * | 3/2002 | Lalezari et al. | 343/915 |
| 6,373,449 | B1 | 4/2002 | Bokulic et al. | |
| 6,384,800 | B1 | 5/2002 | Bassily et al. | |
| 6,437,232 | B1 | 8/2002 | Dailey et al. | |
| 6,441,801 | B1 | 8/2002 | Knight et al. | |
| 6,478,261 | B2 | 11/2002 | Laraway et al. | |
| 6,542,132 | B2 | 4/2003 | Stern | |
| 6,547,190 | B1 | 4/2003 | Thompson et al. | |
| 6,568,638 | B1 | 5/2003 | Capots | |
| 6,581,883 | B2 | 6/2003 | McGee et al. | |
| 6,609,683 | B2 | 8/2003 | Bauer et al. | |
| 6,618,025 | B2 | 9/2003 | Harless | |
| 6,624,796 | B1 | 9/2003 | Talley et al. | |
| 6,637,702 | B1 | 10/2003 | McCandless | |
| 6,702,976 | B2 | 3/2004 | Sokolowski | |
| 6,735,920 | B1 | 5/2004 | Cadogan | |
| 6,772,479 | B2 | 8/2004 | Hinkley et al. | |
| 6,775,046 | B2 | 8/2004 | Hill et al. | |
| 6,828,949 | B2 | 12/2004 | Harless | |
| 6,872,433 | B2 | 3/2005 | Seward et al. | |
| 6,930,654 | B2 | 8/2005 | Schmid et al. | |
| 6,983,914 | B2 | 1/2006 | Stribling et al. | |
| 7,098,867 | B1 | 8/2006 | Gullapalli | |
| 7,429,074 | B2 | 9/2008 | McNight et al. | |
| 7,710,348 | B2 | 5/2010 | Taylor et al. | |
| 7,806,370 | B2 | 10/2010 | Beidleman et al. | |
| 7,897,225 | B2 | 3/2011 | Campbell et al. | |
| 8,061,660 | B2 | 11/2011 | Beidleman et al. | |
| 8,066,227 | B2 | 11/2011 | Keller et al. | |
| 8,109,472 | B1 | 2/2012 | Keller et al. | |
| 8,259,033 | B2 | 9/2012 | Taylor et al. | |
| 2002/0096603 | A1 | 7/2002 | Bauer et al. | |
| 2002/0101008 | A1 | 8/2002 | Sokolowski | |
| 2005/0178921 | A1 | 8/2005 | Stribling et al. | |
| 2007/0200789 | A1 * | 8/2007 | Bassily | 343/915 |
| 2007/0262204 | A1 | 11/2007 | Beidleman et al. | |
| 2008/0006353 | A1 | 1/2008 | Elzey et al. | |
| 2008/0101008 | A1 | 5/2008 | Ulrich et al. | |
| 2010/0188311 | A1 | 7/2010 | Taylor et al. | |
| 2011/0210209 | A1 | 9/2011 | Taylor et al. | |
| 2012/0012154 | A1 | 1/2012 | Keller et al. | |
| 2012/0090660 | A1 | 4/2012 | Keller et al. | |

FOREIGN PATENT DOCUMENTS

| | | | |
|---|---|---|---|
| WO | 03/018853 | A2 | 3/2003 |
| WO | 2009/108555 | A2 | 9/2009 |

OTHER PUBLICATIONS

Abrahamson, Erik R. et al., "Shape Memory Mechanics of an Elastic Memory Composite Resin," Journal of Intelligent Material Systems and Structures, vol. 14, 10 pgs., Oct. 2003.

Barrett, Rory et al., "Deployable Reflectors for Small Satellites," 21st Annual Conference on Small Satellites, 2007, 13 pgs.

Composite Technology Development, Inc., "Rough Order of Magnitude (ROM) Proposal for a 2.5-m Deployable Reflector for TacSat-4," 49 pages, Mar. 1, 2006.

Extended European Search Report and Written Opinion of PCT/US2009/034394 mailed on Jan. 10, 2013, 44 pages.

Keller, Philip N. et al., "Development of Elastic Memory Composite Stiffeners for a Flexible Precision Reflector," American Institute of Aeronautics and Astronautics, 11 pages, no date.

Lin, John K. et al., "Shape Memory Rigidizable Inflatable (RI) Structures for Large Space Systems Applications," AIAA Paper No. 2006-1896, 2 pgs.

NASA, "Technical Support Package—Lightweight, Self-Deploying Foam Antenna Structures," NASA Tech Briefs NPO-30272, 3 pages, no date.

Sokolowski, Witold M. et al., "Lightweight Shape Memory Self-Deployable Structures for Gossamer Applications," 45th AIAA/ASME/ASCE/AHS/ASC Structures, Structural Dynamics & Materials Conference, 10 pages, Apr. 19-22, 2004.

Tan, L. et al., "Stiffening Method for Spring-Back Reflectors," Computational Methods for Shell and Spatial Structures, IASS-IACM 2000, 18 pgs.

International Search Report and Written Opinion of PCT/US09/34397 mailed on Apr. 17, 2009, 7 pages.

International Search Report and Written Opinion of PCT/US2011/023782 mailed on Apr. 20, 2011, 7 pages.

International Search Report and Written Opinion of PCT/US2011/026437 mailed on Jun. 27, 2011; 10 pages.

International Search Report and Written Opinion of PCT/US2011/026745 mailed on May 10, 2011, 11 pages.

Spence, B., et al., "Mars Pathfinder Rover Egress Deployable Ramp Assembly", 30th Aerospace Mechanisms Symposium, NASA Langley Research Center, May 15-17, 1996, 16 pages.

Examination Report dated Aug. 10, 2015 as received in Application No. 10736388.9.

* cited by examiner

DEPLOYABLE REFLECTOR

CROSS-REFERENCE TO RELATED APPLICATION

This application is a continuation-in-part and claims the benefit of, commonly assigned U.S. patent application Ser. No. 12/361,700 filed Jan. 29, 2009, entitled "Furlable Shape Memory Spacecraft Reflector with Offset Feed and a Method for Packaging and Managing the Deployment of Same"; the disclosure of which is incorporated by reference in its entirety herein for all purposes.

BACKGROUND

This disclosure relates in general to deployable antenna reflectors and, but not by way of limitation, to deployable reflectors utilizing shape-memory polymers among other things.

Antennas are designed to concentrate RF energy being broadcast or received into a directional beam to reduce the power required to transmit the signal. A reflective antenna uses one or more large surfaces, or reflectors, to reflect and focus the beam onto a feed. Spacecraft often employ large reflectors that must be reduced in size for launch and which are deployed on orbit. A deployable antenna reflector should be light weight, have a small stowage-to-deployment volumetric ratio, provide an efficient reflective surface, and be as simple as possible to deploy.

BRIEF SUMMARY

A shape-memory deployable reflector is disclosed according to one embodiment. The shape-memory reflector may be configured to maintain both a first stowed configuration and a second deployed configuration. The shape-memory reflector may include a reflective surface, a plurality of linear stiffeners (longitudinal stiffeners) and a plurality of shape-memory stiffeners (panel shape-memory stiffeners). Both the linear stiffeners and the shape-memory stiffeners are coupled with the reflective surface. In the deployed configuration the plurality of shape-memory elements are unpleated and the reflector surface may define a doubly curved three dimensional geometry. In the stowed configuration the plurality of shape-memory stiffeners may be pleated into a first plurality of pleats and the reflector surface is pleated into a second plurality of pleats. The shape-memory reflector may be configured to deploy into the deployed configuration by heating one or more of the shape-memory stiffeners to a temperature greater than a glass transition temperature of the shape-memory stiffeners.

In some embodiments, the deployed three dimensional geometry of the reflector surface may comprise a non-axially symmetric geometry or an off-axis paraboloid. The paraboloid surface may be modified by local contouring to distribute the beam of the antenna into some desired shape other than circular. In some embodiments, at least a subset of the plurality of shape-memory stiffeners are arranged substantially parallel to one another. In some embodiments, at least a subset of the plurality of linear stiffeners are arranged substantially parallel to one another. In some embodiments, at least a subset of the plurality of linear stiffeners are arranged perpendicular to at least a subset of the plurality of shape-memory stiffeners. The reflector surface, for example, may include a graphite composite laminate. The shape-memory stiffener, for example, may comprise a shape-memory polymer having a glass transition temperature that is less than a survival temperature of the shape-memory polymer.

In some embodiments, the shape-memory stiffeners may comprise a composite panel including a first face sheet of elastic material, a second face sheet of elastic material, and a shape-memory polymer core sandwiched between the first face sheet and the second face sheet, wherein the first face sheet includes a portion of the reflector surface. The plurality of linear stiffeners, for example, may comprise a laminate material and/or a solid material, wherein one face of the stiffener may include a portion of the reflector surface. The shape-memory reflector, for example, may include one or more heaters coupled with the shape-memory stiffener.

A method for stowing a shape-memory reflector is provided according to another embodiment. The method may include fabricating the shape-memory reflector in a deployed configuration. The shape-memory reflector may include a reflector surface, a plurality of linear stiffeners coupled with the reflector surface, and a plurality of shape-memory stiffeners coupled with the reflector surface. The plurality of shape-memory stiffeners may be heated to a temperature above the glass transition temperature of the shape-memory stiffeners and mechanical loads may be applied to deform the shape-memory reflector into a stowed configuration. The shape-memory stiffeners may then be cooled to a temperature below the glass transition temperature of the shape-memory stiffeners and the mechanical loads may be removed, allowing the cooled shape-memory stiffeners to maintain the stowed configuration.

A method for deploying a shape-memory reflector from a stowed configuration is provided according to another embodiment. The shape-memory reflector includes a reflector surface, a plurality of linear stiffeners coupled with the reflector surface, and a plurality of shape-memory stiffeners coupled with the reflector surface. In the stowed configuration, the plurality of shape-memory elements are pleated into a plurality of pleats and the reflector surface is pleated into a plurality of pleats. The plurality of shape-memory stiffeners may be heated to a temperature above the glass transition temperature of the shape-memory stiffeners. The shape-memory stiffeners may then be allowed to transition from a pleated configuration to a non-pleated configuration. The plurality of shape-memory stiffeners may then be cooled to a temperature below the glass transition temperature of the shape-memory stiffeners.

Some embodiments of the invention are directed toward a reflector that includes a deployed configuration and a stowed configuration. In the deployed configuration the reflector can include a three dimensional geometry and in the stowed configuration the reflector can include a plurality of pleats. And the reflector can include a front surface and a back surface. The back surface of the reflector can be coupled with a plurality of trusses such that in the stowed configuration each truss is positioned within a valley of one of the reflector surface pleats. And a plurality of crossbeams can be disposed between two of the trusses. The plurality of cross beams can form pleats when in the stowed configuration.

Further areas of applicability of the present disclosure will become apparent from the detailed description provided hereinafter. It should be understood that the detailed description and specific examples, while indicating various embodiments, are intended for purposes of illustration only and do not limit the scope of the disclosure.

Figure 1:
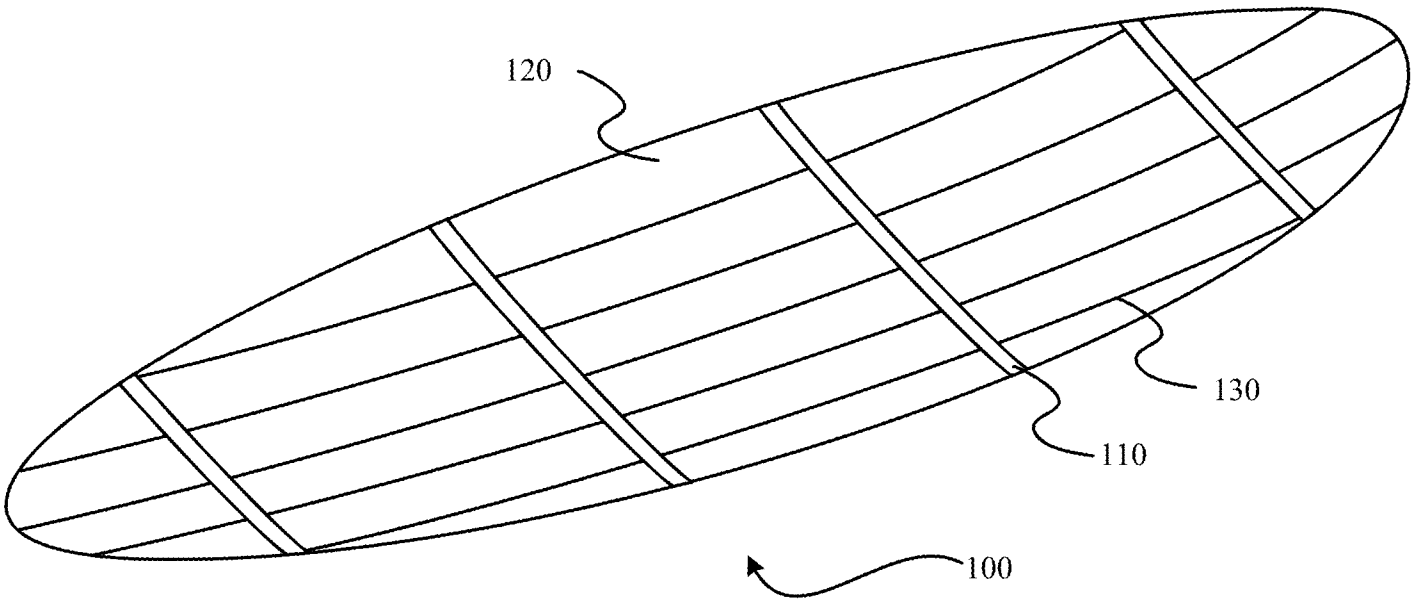
FIG. 1 shows a furlable shape-memory reflector in a deployed configuration according to one embodiment.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides various embodiments of the invention only, and is not intended to limit the scope, applicability or configuration of the disclosure. Rather, the ensuing description of the embodiments will provide those skilled in the art with an enabling description for implementing an embodiment. It should be understood that various changes may be made in the function and arrangement of elements without departing from the spirit and scope as set forth in the appended claims.

Embodiments of the present disclosure are directed toward shape-memory reflectors. Such shape-memory reflectors may be adapted for space communication applications. The shape-memory reflector may be prepared and launched in a packaged (or stowed or furled) configuration that maintains the packaged shape, reducing the number of mechanical devices required to secure the reflector during launch. Once in space, the shape-memory reflector may be deployed with few or no moving parts. For example, the shape-memory reflector may be in an offset fed shape, a parabolic shape or an irregular shape in a deployed configuration and stowed in a furled and/or folded configuration. The shape-memory reflector may include a surface of substantially continuous, elastic reflector material. For example, the elastic reflector material may comprise a laminate of composite polymer layers.

The shape-memory reflector may include a shape-memory stiffener that is used to actuate the reflector from the packaged configuration to the deployed configuration when heated above $T_g$. The shape-memory stiffener may include a sandwich of flexible face sheets around a core of shape-memory material, for example, a shape-memory polymer and/or foam. One of the flexible face sheets may include the reflector material. The shape-memory stiffener may be attached circumferentially on the reflector material. In one embodiment, the panel shape-memory stiffeners may be attached along a surface of the reflector material. In another embodiment, the shape-memory stiffener may be attached circumferentially with various other circumferences of the reflector material with a radius less than or equal to the radius of the paraboloid.

In various embodiments, the shape-memory reflector may also include a plurality of longitudinal stiffeners that are, for example, longitudinally attached with the back surface of the reflector material. In some embodiments, the longitudinal stiffeners may extend along the reflector material substantially perpendicularly to the panel shape-memory stiffeners.

FIG. 1 shows a shape-memory reflector 100 in a deployed configuration according to one embodiment. Shape-memory reflector 100, in some embodiments, may be deployed in a non-asymmetric shape, such as an off-axis paraboloid. In other embodiments, the shape-memory reflector 100 may be deployed in any shape, including irregular shapes. The shape-memory reflector 100 includes a substantially continuous reflector material 120. The reflector material 120 may include a graphite-composite laminate with between one and six plies. Various other materials such as thin metallic membranes, epoxy films, or other laminates may be used. The laminates may include various thicknesses. The reflector material 120 may be formed on a parabolic mandrel during manufacture. The reflector material 120 may be an elastic material that is stiff in its plane and relatively flexible in bending. The reflector material may be thin enough to bend to a radius of a few inches without permanent deformation.

Figure 5A:
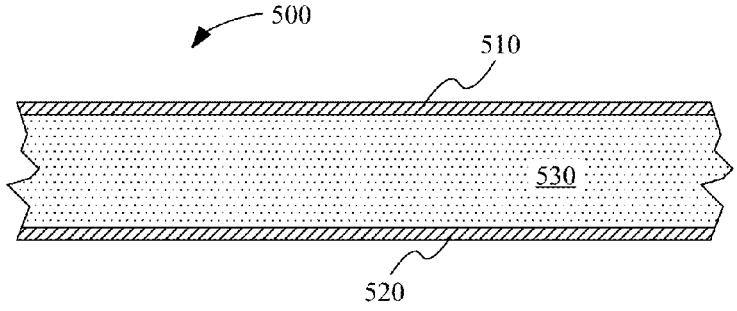
FIG. 5A shows a cross section of a shape-memory stiffener according to one embodiment.

Shape-memory reflector 100 shown in FIG. 1 may be deployed in an off-axis paraboloid shape. Shape-memory reflector 100 includes a plurality of panel shape-memory stiffeners 110 and a plurality of longitudinal stiffeners 130. Panel shape-memory stiffeners 110 may comprise any shape-memory material described in commonly assigned U.S. patent application Ser. No. 12/033,584, filed 19 Feb. 2008, entitled "Highly Deformable Shape-memory Polymer Core Composite Deformable Sandwich Panel," which is incorporated herein by reference for all purposes. FIG. 5A shows a cross section of an example of shape-memory material that may be used.

In one embodiment, panel shape-memory stiffener 110 comprises a sandwich including a first face sheet, a shape-memory core and a second face sheet. The first and second face sheets may include laminates or layers of composite material. In one embodiment, the reflector material 120 may comprise the first face sheet. The second face sheet may include the same material as the reflector material and may be coupled therewith. The shape-memory core may comprise shape-memory polymer foam. A plurality of panel shape-memory stiffeners may be arrayed along reflective surface 120 and coupled thereto.

Figure 4A:
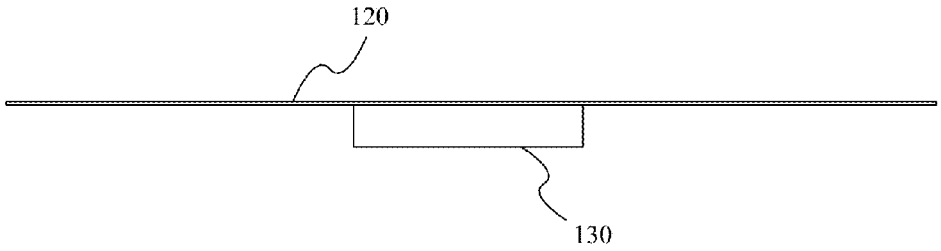
FIG. 4A shows a cross-section of a panel stiffener according to one embodiment.

Longitudinal stiffeners 130 may be arrayed along a surface of the reflective surface 120. Longitudinal stiffeners 130, for example, may be arrayed substantially equidistant from each other along the reflective surfaces. Longitudinal stiffeners 130 may also comprise a thick layer of solid material, such as a thick layer of the same material as the reflector material 120. Longitudinal stiffeners 130 may also comprise plies of graphite composite laminate co-cured with the reflector material 120 during fabrication, or the longitudinal stiffeners 130 may also comprise a strip of composite or other material secondarily bonded to the reflector material 120. The cross section of the radial stiffener may be rectangular, as shown in FIG. 4A, or any other shape, for example, a trapezoid formed by stacking narrower plies of composite on a wider base.

In one embodiment, longitudinal stiffeners 130 may be continuous, flexible, non-collapsible sections. The longitudinal stiffeners 130 may provide sufficient stiffness and dimensional stability in the deployed state so as to maintain the shape of the reflective surface 110. Longitudinal stiffeners 130 may also include sufficient flexibility in bending to enable them to be straightened during packaging. The longitudinal stiffeners may also have sufficient strength longitudinally to react to radial tensile loads in the reflective surface that are applied during packaging. Furthermore, the longitudinal stiffeners 130 may have sufficient local strength to provide mounting locations for launch support structures and packaging loads. In some embodiments, longitudinal stiffeners 130 may be arrayed substantially perpendicular to the panel shape-memory stiffeners 110 along reflective surface 120. In some embodiments, longitudinal stiffeners 130 may be arrayed in a non-perpendicular arrangement.

Figure 2A:
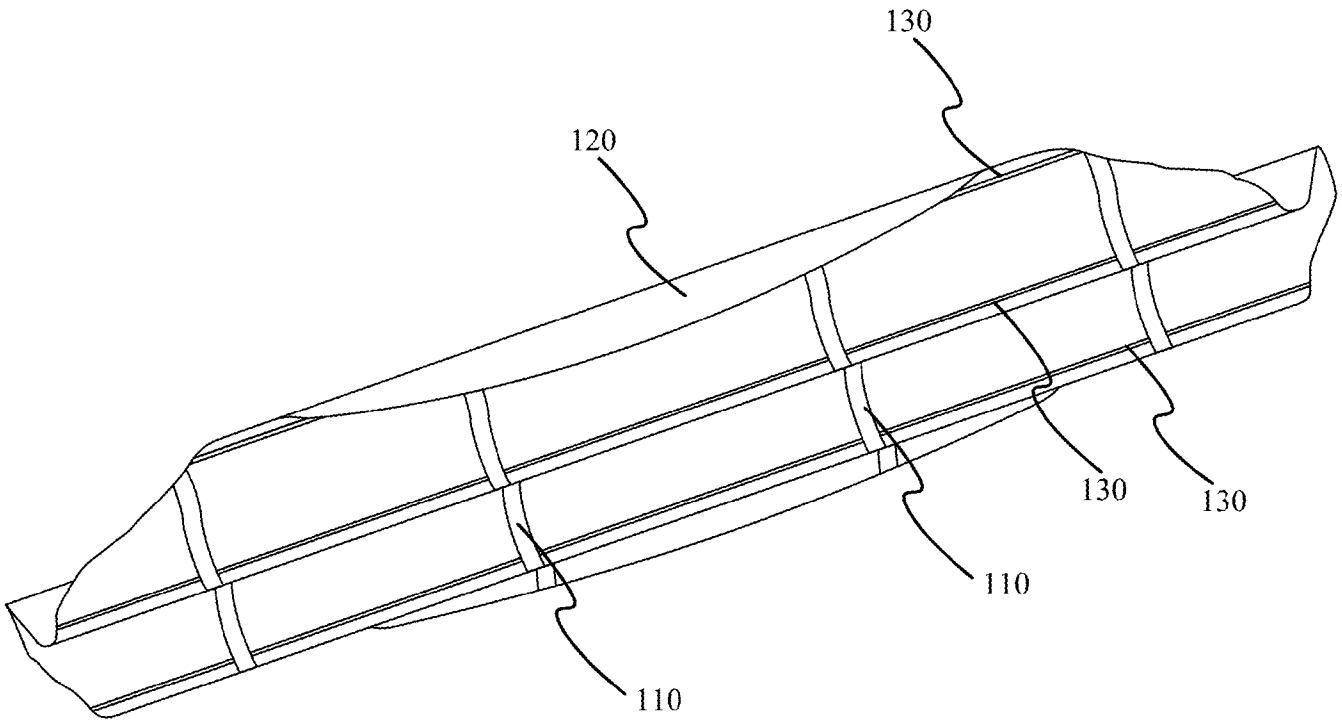
FIG. 2A shows a perspective view of a furlable shape-memory reflector in a stowed configuration according to one embodiment.
Figure 2B:
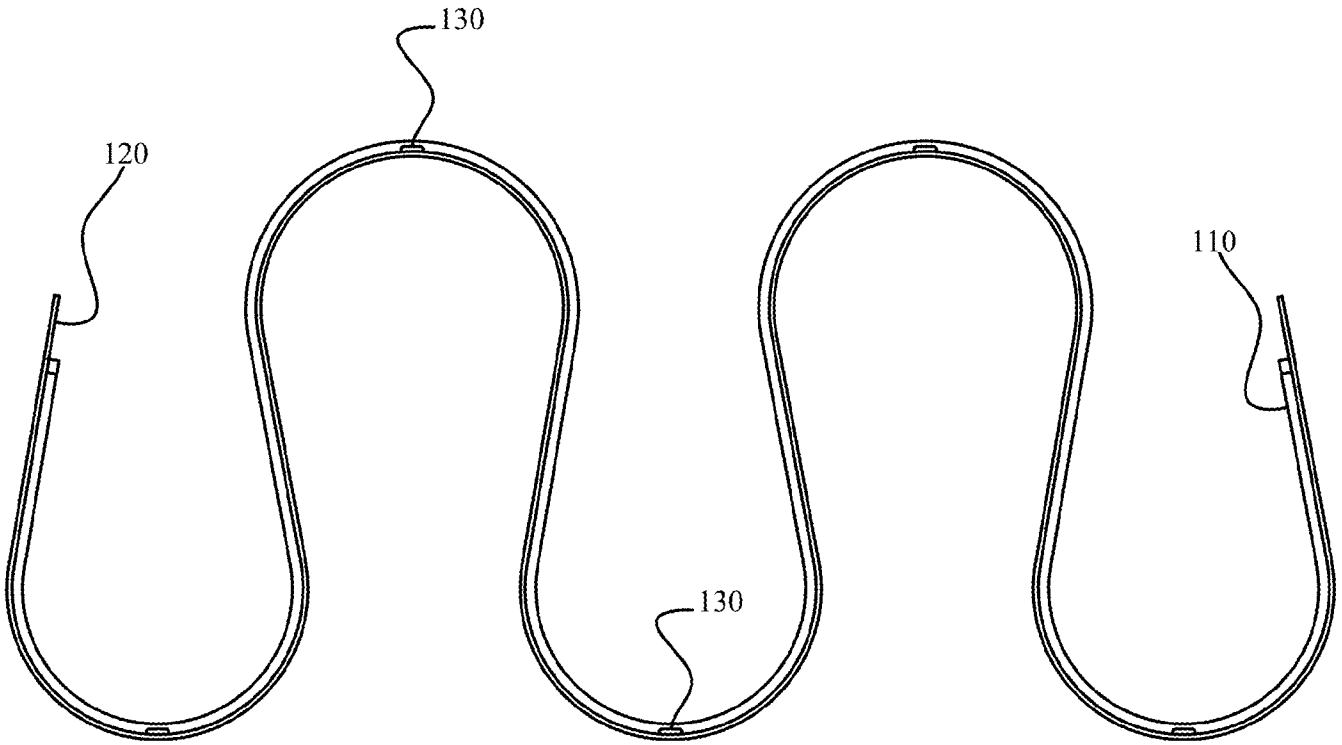
FIG. 2B shows an end view of a furlable shape-memory reflector in a stowed configuration according to one embodiment.

FIG. 2A shows a perspective view of a shape-memory reflector 100 in the stowed configuration according to some embodiments. FIG. 2B shows a end view of a shape-memory reflector 100 in the stowed configuration according to some embodiments. The shape-memory reflector 100, shown in FIGS. 2A and 2B, has five bends. These bends may also be formed within the panel shape-memory stiffeners 110 and the reflective surface 120 as shown. The bends (or pleats), in some embodiments, may also occur along the longitudinal stiffeners 130 of the shape-memory reflector 100. Longitudinal stiffeners 130 may be positioned at the apex of the bends.

Figure 3A:
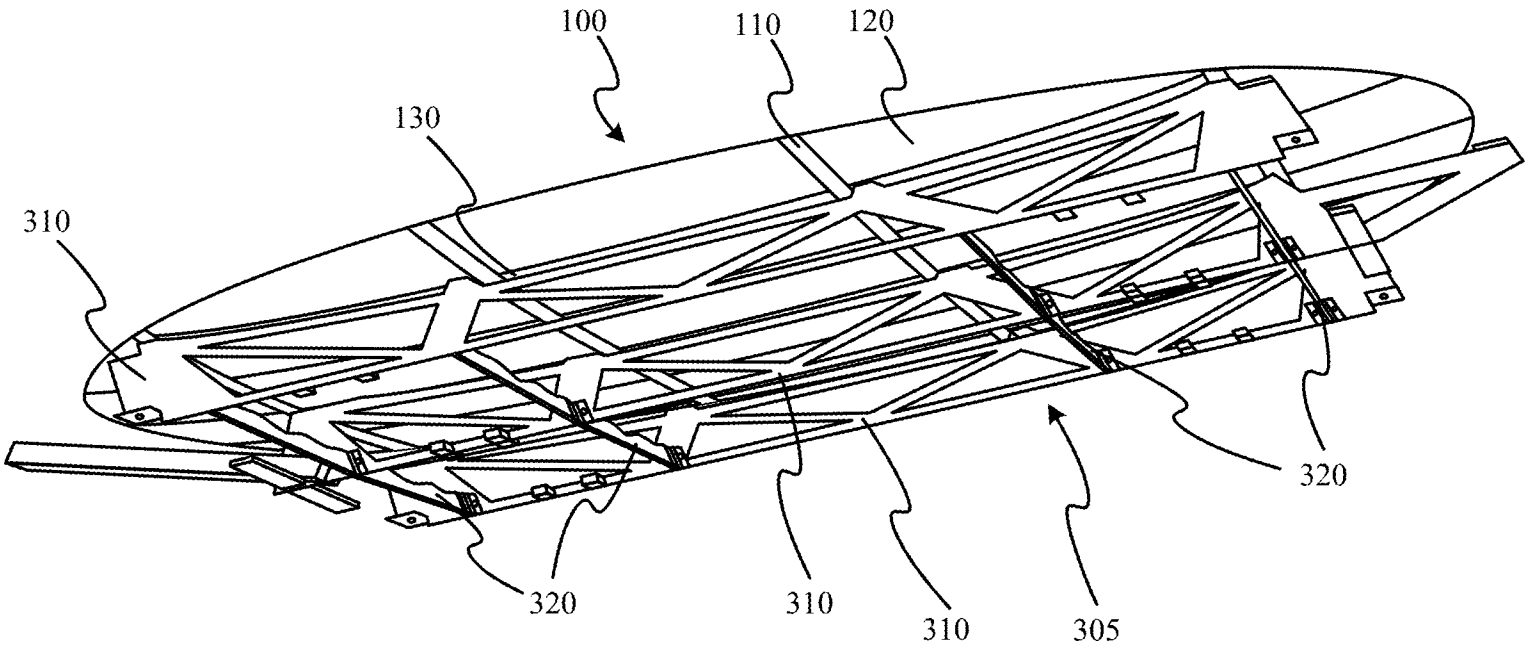
FIG. 3A shows a furlable shape-memory reflector in a deployed configuration along with backing structures according to one embodiment.
Figure 3B:
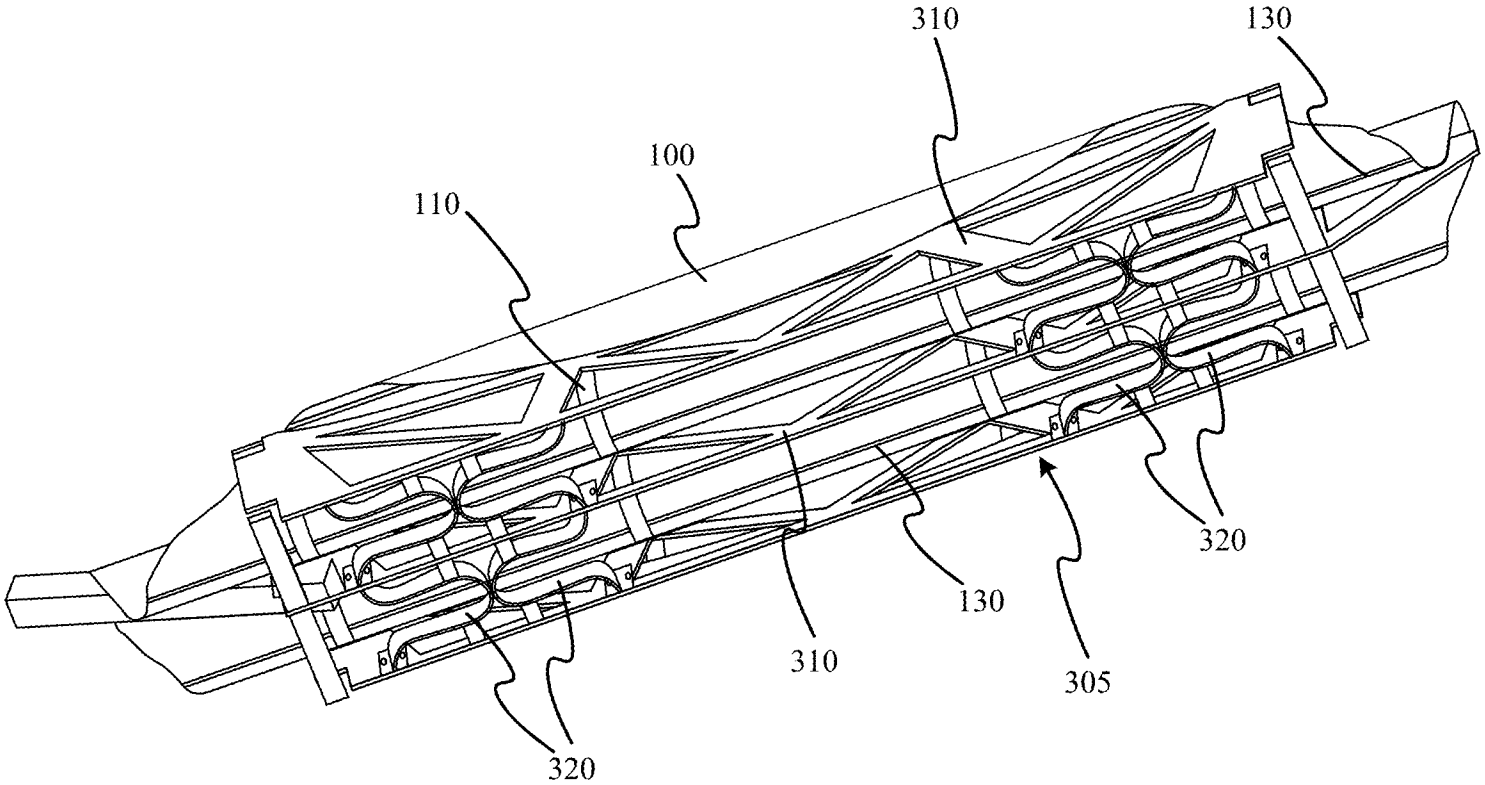
FIG. 3B shows a furlable shape-memory reflector in a stowed configuration along with backing structures according to one embodiment.

In some embodiments, shape-memory reflector 100 is coupled with a backing structure. FIG. 3A shows a furlable shape-memory reflector 100 in a deployed configuration along with backing structure 305 according to one embodiment. FIG. 3B shows a furlable shape-memory reflector 100 in a stowed configuration along with backing structure 305 according to one embodiment. The backing structure may include a series of rigid beams 310. Rigid beams 310 may be substantially parallel with longitudinal stiffeners 130. In some embodiments, rigid beams 310 may be coupled with longitudinal stiffeners 130. In some embodiments, rigid beams 310 may be coupled with alternating longitudinal stiffeners 130. Collapsible stiffeners 320 may span between rigid beams 310. The backing structure 305 may provide deployed stiffness and/or dimensional accuracy. Moreover, the reflector may be attached to, and supported by, the backing structure 305. Backing structure 305 may include a number of radial arms that pivot inward for packaging and deployable truss elements to lock the arms into the deployed position. As shown in FIG. 3A and FIG. 3B, the backing structure may collapse for stowage and expand during deployment, according to some embodiments.

FIG. 4A shows a cross section of a longitudinal stiffener 130 coupled with reflector material 120 according to one embodiment. The cross section of longitudinal stiffener 130 may be rectangular, as shown, or any other shape, for example, a trapezoid formed by stacking narrower plies of composite on a wider base. In other embodiments, longitudinal stiffener 130 may have a semi-circular, semi-oval, concave and/or convex cross section shape.

Figure 4B:
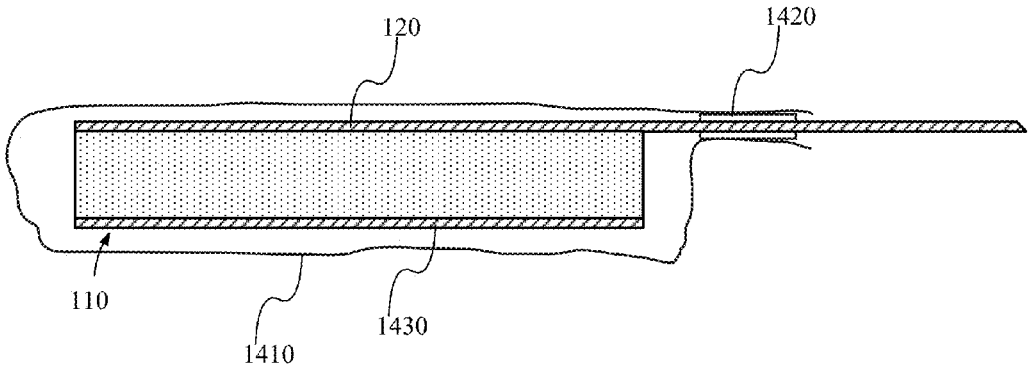
FIG. 4B shows a cut-away view of a panel shape-memory stiffener coupled with an elastic reflector material according to one embodiment.

FIG. 4B shows a cut away view of panel shape-memory stiffener 110 coupled with an outer edge reflector material 120 according to one embodiment. Panel shape-memory stiffener 110 may be enclosed, for example, within a protective covering 1410, such as, for example, multi-layer insulation (MLI). Protective covering 1410 may be coupled with reflector material 120 using any of various adhesives 1420. Note that, in such embodiments, shape-memory stiffener 110 may be coupled with the elastic reflector material 120. Reflector material 120, in some embodiments, comprises one of the face sheets of the shape-memory stiffener 110. Elastic material 1430 comprises the second face sheet of shape memory stiffener 110 and may, in some embodiments, be of the same composition as reflector material 120.

FIG. 5A shows a cross section of a portion of panel shape-memory stiffener 500 according to one embodiment. In one embodiment, panel shape-memory stiffener 500 may be fabricated in various shapes as a panel shape-memory stiffener 110 and attached to the convex surface of the reflector shown in FIG. 1 according to one embodiment. In another embodiment, the panel shape-memory stiffener 500 may also be fabricated with a plurality of discrete shape-memory cores 530 or with discrete pieces of shape-memory core 530 coupled together into a panel shape-memory stiffener 110. Panel shape-memory stiffener 500 may include a first face sheet 510, a second face sheet 520 and a shape-memory core 530. In some embodiments, first and/or second face sheets 510, 520 may comprise the same material or, in other embodiments, first and/or second face sheets 510, 520 may comprise material similar to reflector material 120. Shape-memory core 530 may be in substantially continuous contact with both the first face sheet 510 and the second face sheet 520. That is, the core, in some embodiments, may not be segmented, but instead is in mostly continuous contact with the surface of both face sheets. In other embodiments, the shape-memory core 530 may be in continuous contact with about 75%, 80%, 85%, 90%, 95% or 100% of either and/or both first face sheet 510 and/or second face sheet 520. In some embodiments, however, core 530 may comprise a plurality of discrete shape-memory cores coupled together. Each such discrete core may be coupled with first face sheet 510 and/or second face sheet 520.

First face sheet and/or second face sheet 510, 520 may comprise a thin metallic material according to one embodiment. In other embodiments, first face sheet and/or second face sheet 510, 520 may include fiber-reinforced materials. First face sheet and/or second face sheet 510, 520 may comprise a composite or metallic material. First face sheet and/or second face sheet 510, 520 may also be thermally conductive. The shape-memory core 530 may comprise a shape-memory polymer and/or epoxy, for example, a thermoset epoxy. Shape-memory core 530 may also include either a closed or open cell foam core. Shape-memory core 530 may be a polymer foam with a $T_g$ lower than the survival temperature of the material. For example, the shape-memory core may comprise TEMBO® shape-memory polymers, TEMBO® foams or TEMBO® elastic memory composites.

Figure 5B:
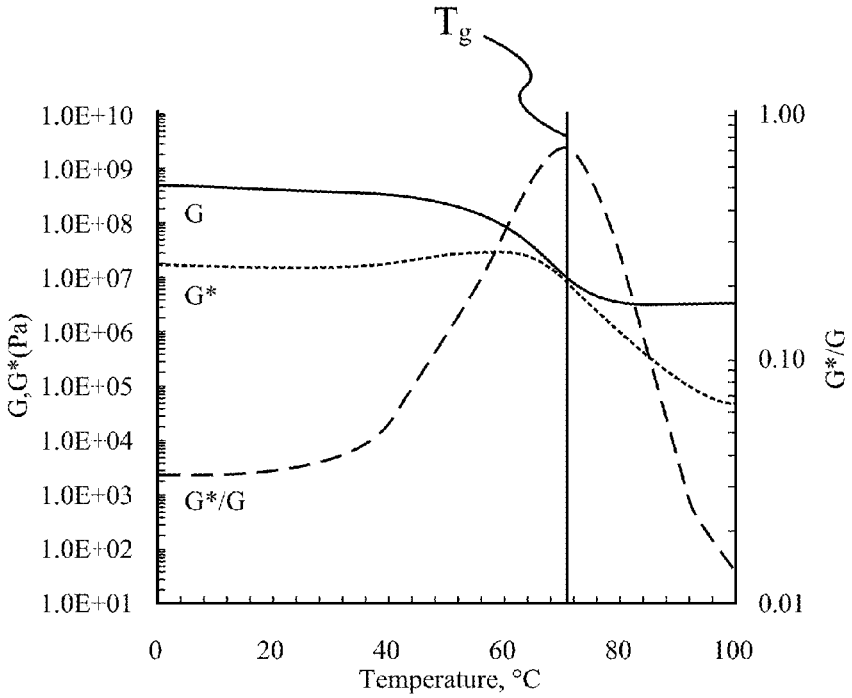
FIG. 5B shows a graph of the shear modulus G, the complex shear modulus G*, and the ratio of the shear modulus to the complex shear modulus G*/G of an exemplary shape-memory material according to one embodiment.

FIG. 5B shows a graph of the shear modulus G, the complex shear modulus G*, and the ratio of the shear modulus to the complex shear modulus G*/G of an exemplary shape-memory material according to one embodiment. The peak in the G*/G curve is defined as the glass transition temperature ($T_g$) of the shape-memory material. Above $T_g$, glasses and organic polymers become soft and capable of plastic deformation without fracture. Below $T_g$, the joining bonds within the material are either intact, or when cooling increase as the material cools. Thus, below $T_g$, materials often become stiff, brittle and/or strong.

Panel shape-memory stiffeners may be a continuous shape-memory sandwich as described above. Panel shape-memory stiffeners may also include a plurality of shape-memory elements coupled together on the surface of the reflector element. Panel shape-memory stiffeners may be collapsible, yet strong and stiff shape-memory polymer based stiffener. Panel shape-memory stiffeners may have sufficient stiffness and dimensional stability in the deployed state (at temperatures below $T_g$) so as to maintain the paraboloid shape of the reflective surface. Moreover, panel shape-memory stiffeners may have sufficient strain and strain energy storage capability at temperatures above $T_g$ to allow packaging the reflector without damage to the reflective surface. Panel shape-memory stiffeners may also include sufficient stiffness and dimensional stability in the packaged state, at temperatures below $T_g$, so as to maintain the packaged shape of the reflector without extensive launch locks. Also, panel shape-memory stiffeners may include sufficient dampening during actuation at temperatures above $T_g$ to effectively control un-furling of the reflective surface.

Figure 6:
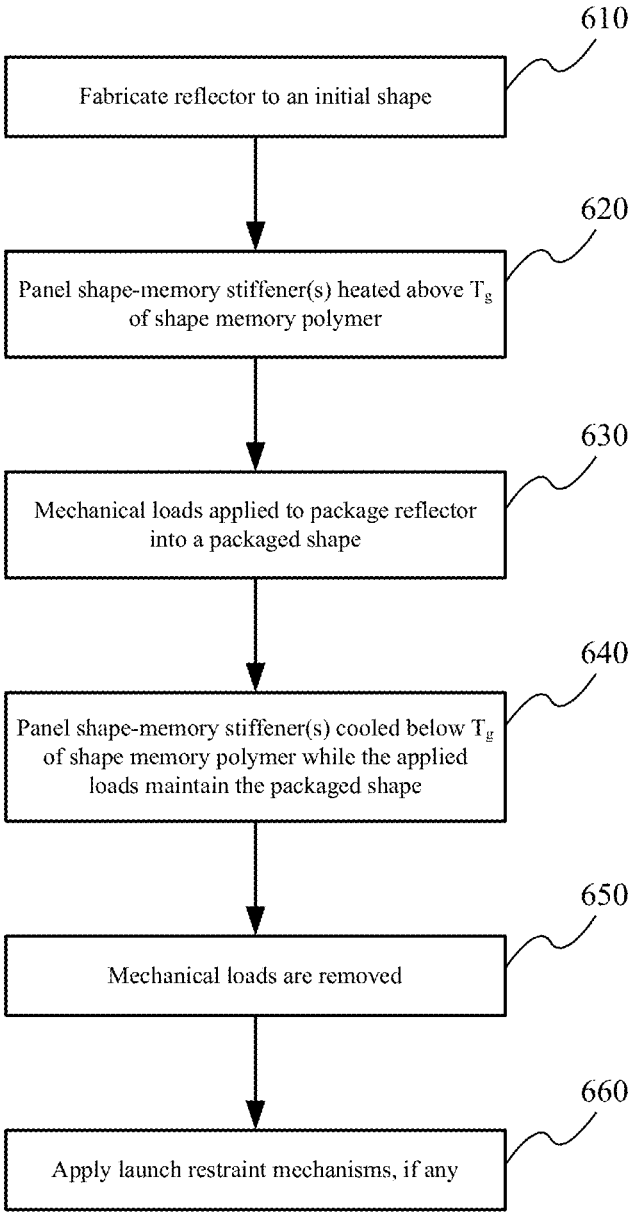
FIG. 6 shows a flowchart of a method for packaging a shape-memory reflector according to one embodiment.

FIG. 6 shows a flowchart of a method for packaging a shape-memory reflector according to one embodiment. At block 610, the reflector is fabricated with an initial deployed shape. The reflector may also be fabricated with panel shape-memory stiffeners and/or longitudinal stiffeners. This deployed configuration may provide a minimum strain energy shape for the reflector. At block 620, the panel shape-memory stiffeners are heated to a temperature above $T_g$ of the shape-memory polymer within the panel shape-memory stiffener. At block 630, mechanical loads are applied to deform reflector into a packaged shape, such as, for example, the packaged shape shown in FIGS. 2A and 2B. At block 640 the panel shape-memory stiffeners are cooled to a temperature below $T_g$ of the shape-memory polymer while the packaged shape is maintained with the applied loads; following which, at block 650, the mechanical loads are removed and the panel shape-memory stiffeners maintain their packaged shape due to strain energy storage in the cooled shape-memory polymer core. The reflector will remain in its packaged condition with minimal or no external loads until deployment. The pleats are stabilized for launch loading by bending stiffness of the packaged shape memory stiffener 110. In some applications, launch restraint mechanisms may be applied at block 660.

Figure 7:
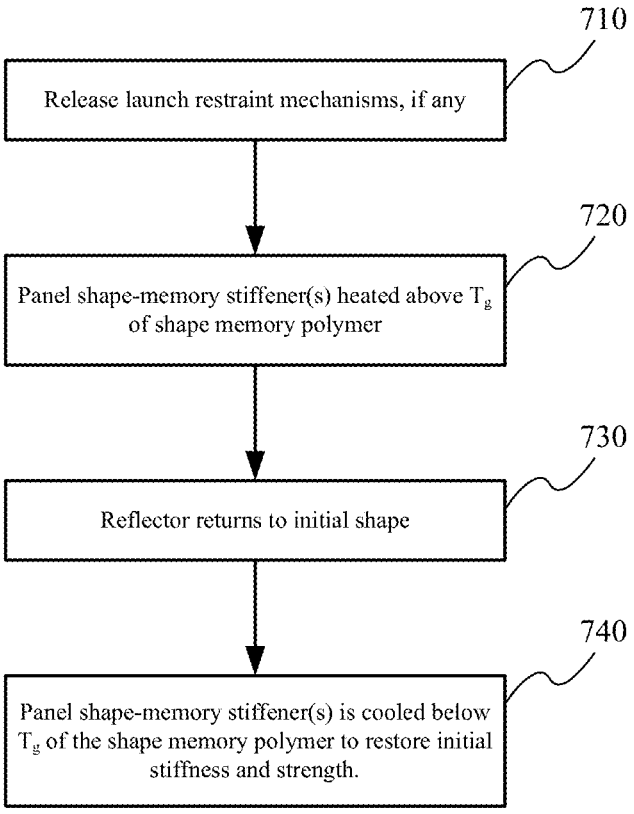
FIG. 7 shows a flowchart of a method for deploying a shape-memory reflector according to one embodiment.

FIG. 7 shows a flowchart of a method for deploying a shape-memory reflector according to one embodiment. At block 710, launch restraints, if any, are released. The panel shape-memory stiffeners may then be heated to a temperature above $T_g$ of the shape-memory polymer within the panel shape-memory stiffeners at block 720. During this heating, the panel shape-memory stiffeners straighten out of reversing bends, allowing the reflector to return to its initial shape with minimal or no external mechanical loads at block 730. At block 740, the shape-memory stiffeners are cooled to a temperature below $T_g$ of the shape-memory polymer. The initial stiffness and/or strength of the shape-memory polymer may be restored upon cooling.

Figure 8A:
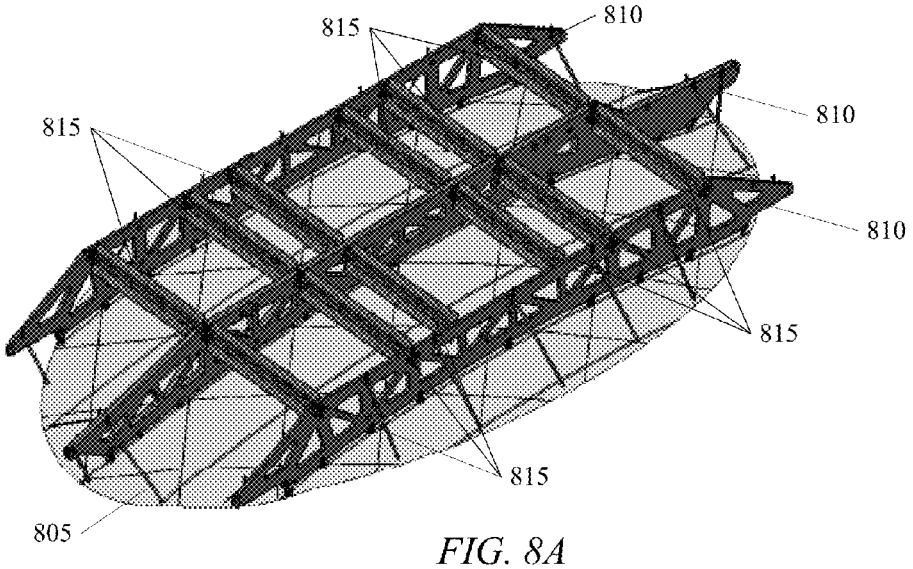
FIGS. 8A, B, C, and D show a reflector with a backing structure according to some embodiments of the invention.

FIGS. 8A, B, C, and D show a deployable reflector system with a backing structure according to some embodiments of the invention. A deployable reflector system can include reflector 805, which may be deployed in a non-asymmetric shape, such as an off-axis paraboloid. In other embodiments, the reflector 805 may be deployed in any shape, including irregular shapes. The reflector 805 may include a substantially continuous reflector material 120. Reflector 805 may include a graphite-composite laminate with between one and six plies. Various other materials such as thin metallic membranes, epoxy films, or other laminates may be used. The laminates may include various thicknesses. The reflector material may be formed on a parabolic mandrel during manufacture. The reflector material may be an elastic material that is stiff in its plane and relatively flexible in bending. The reflector material may be thin enough to bend to a radius of a few inches without permanent deformation.

The backing structure can include a plurality of trusses 810. Truss 810 can be a rigid composite panel. Each truss 810 can have any number of weight saving voids within the truss. Trusses 180 can be aligned substantially parallel to one another as shown in FIG. 8A. There can be some variation in how the trusses are aligned one with another. For instance, trusses 180 can be arranged at an angle relative to one another; for example, at 1°, 2°, 3°, 4°, 5°, 6°, 7°, 8°, 9°, 10°, etc. relative to one another. Trusses 810 can be rigid such that when stowed, deployed or during deployment they largely retain their size, shape, and configuration.

In some embodiments reflector 805 can be formed without integral stiffeners such as shape-memory stiffener and/or longitudinal stiffeners.

Trusses 810 can be coupled with the back surface of reflector 805 at plurality of discrete connection points. For instance, trusses 810 can be coupled with reflector 805 using flexible coupling devices like those shown in FIGS. 11A, B, C, and D. These flexible coupling devices can allow the backing structure and the reflector to move relative to one another at the connection point during transition from the stowed configuration to the deployed configuration. This can be important to minimize stresses and/or strains in the reflector and/or connectors during deployment and stowage.

Figure 8B:
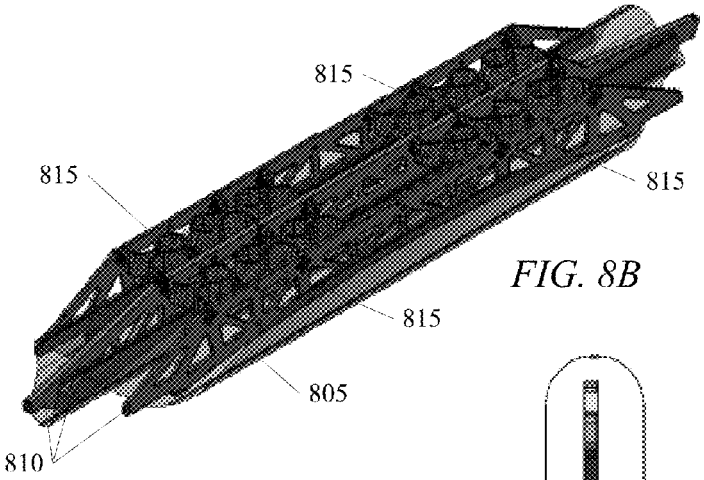
Figure 8C:
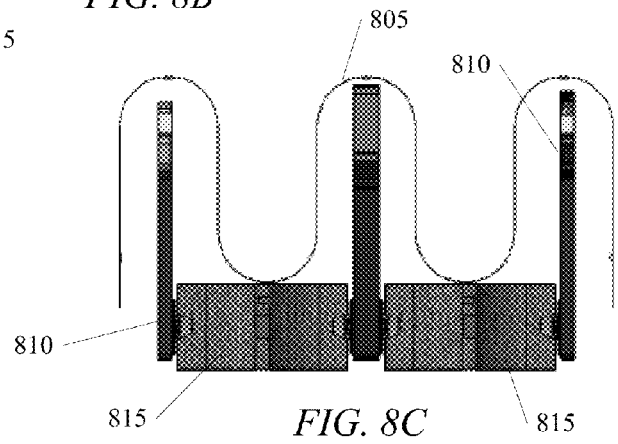
Figure 8D:
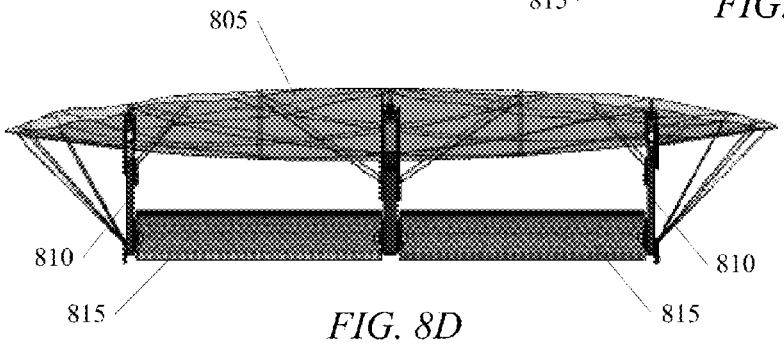

The deployable reflector system can include a plurality of crossbeams 815. Each crossbeam 815 can be coupled with two trusses 810. In some embodiments, each crossbeam 815 may not be coupled with reflector 805. In some embodiments, crossbeams 815 may be constructed from a shape memory polymer material (e.g., Tembo®). As shown in FIGS. 8B and 8C, crossbeams 815 can be pleated when the deployable reflector system is in the stowed configuration. And, as shown in FIGS. 8A and 8D, crossbeams 815 can be extended when in the deployed configuration. In some embodiments crossbeams 815 can be substantially perpendicular with trusses 810.

In some embodiments shape memory polymer crossbeams 815 can be manufactured in the deployed configuration. In this configuration, crossbeams 815 can be coupled with reflector 805. At some later time, crossbeams 815 can be heated to a temperature above the glass transition temperature of the shape memory polymer, formed into the stowed configuration, and cooled. Once cooled, crossbeams 815 will retain their shape in the stowed configuration.

During deployment of the deployable reflector system, crossbeams 815 can be heated to a temperature above the glass transition temperature of the material (e.g., shape memory polymer) comprising the crossbeam. At this temperature each crossbeam will naturally return to the deployed configuration. Crossbeams 815 can be coupled with an electric and/or resistive heater that can be used to heat the cross beam.

In some embodiments a releasable coupling device can be used to couple portions of reflector 805 with portions of crossbeams 815 in the stowed configuration. This releasable coupling can provide structural strength to the entire stowed configuration, which can be useful during transportation, integration, and launch of a satellite. A releasable coupling may include a simple ball and socket coupling without any permanent connectors.

While the figures show eight crossbeams 815 placed between two trusses 810, any number of crossbeams 815 can be used.

Figure 9A:
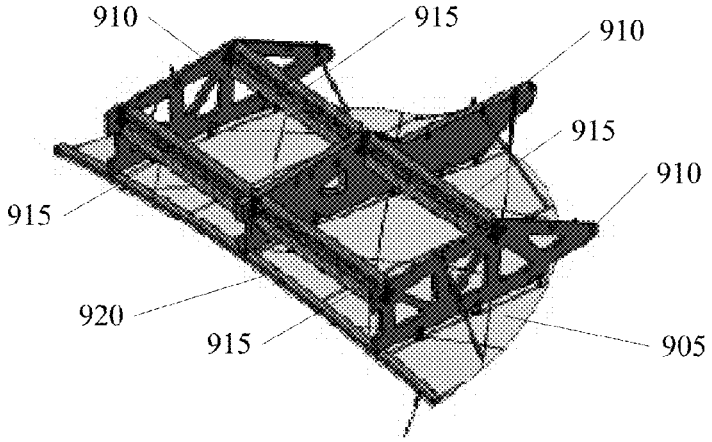
FIGS. 9A, B, and C show a reflector with a backing structure and stiffener according to some embodiments of the invention.

FIGS. 9A, B, and C show a deployable reflector system with a backing structure like that shown in FIGS. 8A, 8B, 8C, and 8D along with stiffener 920 according to some embodiments of the invention. Stiffer 920 can be coupled with reflector 905 and/or trusses 910 using a plurality of flexible coupling devices (e.g., like those discussed elsewhere) at discrete locations. In some embodiments a plurality of stiffeners can be implemented. In some embodiments stiffener 920 can be coupled with the back surface of reflector 905. In some embodiments stiffener 920 can include shape memory polymer (e.g., Tembo®).

In some embodiments stiffener 920 can be substantially parabolic and/or can extend along a portion of the back surface of reflector 905. In some embodiments stiffener(s) 920 can be non-circular. In some embodiments shape-memory reflector is configured to deploy into the deployed configuration by heating the stiffener(s) to a temperature greater than a glass transition temperature of the shape-memory.

In some embodiments stiffener 920 can provide structural stiffness to the deployable reflector system. In some embodiments stiffener 920 can also provide membrane strain energy storage. In some embodiments stiffener 920 can comprise shape memory polymer material (e.g., Tembo®).

In some embodiments shape memory polymer stiffener(s) 920 can be manufactured in the deployed configuration. In this configuration, stiffener(s) 920 can be coupled with reflector 905 and/or trusses 910. At some later time, stiffener(s) 920 can be heated to a temperature above the glass transition temperature of the shape memory polymer, formed into the stowed configuration, and cooled. Once cooled, stiffener(s) 920 will retain their shape in the stowed configuration.

During deployment of the deployable reflector system, stiffener(s) 920 can be heated to a temperature above the glass transition temperature of the shape memory polymer material (e.g., shape memory polymer) comprising the crossbeam. At this temperature each crossbeam will return to the deployed configuration. Each stiffener 920 can be coupled with an electric and/or resistive heater that can be used to heat stiffener 920.

Figure 10A:
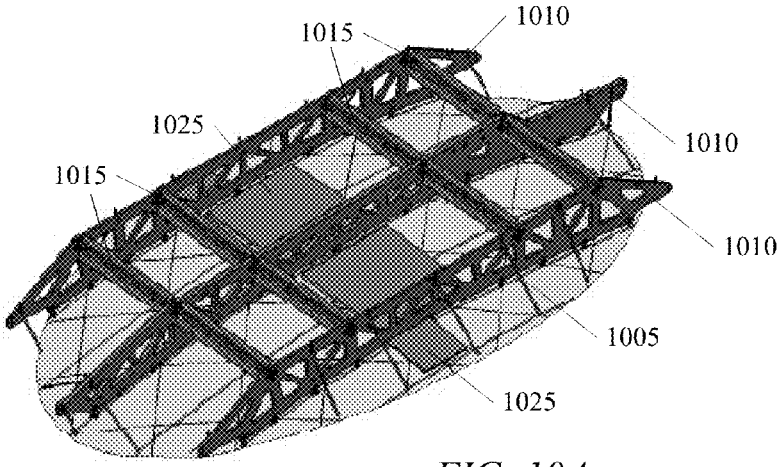
FIGS. 10A, B, C, and D show a reflector with a backing structure and offset panels according to some embodiments of the invention.
Figure 10B:
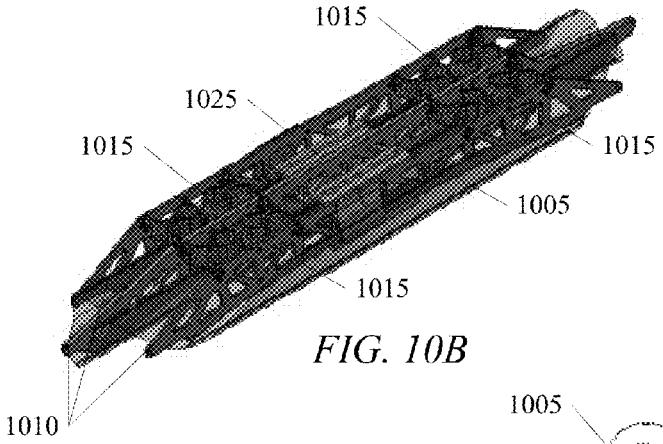
Figure 10C:
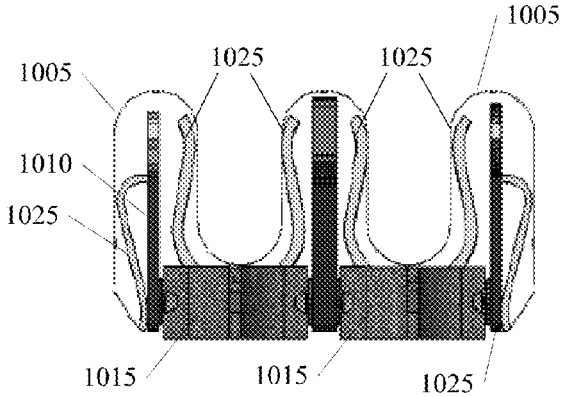
Figure 10D:
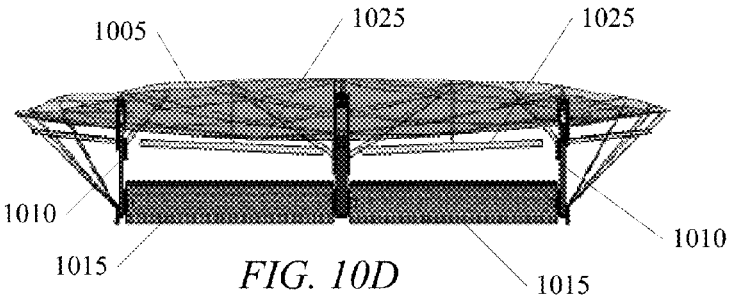

FIGS. 10A, B, C, and D show a deployable reflector system with a backing structure like that shown in FIGS. 8A, 8B, 8C, and 8D along with and offset panels 1025 according to some embodiments of the invention. As shown, separate offset panels 1025 are positioned between two trusses 1010 and/or between a truss 1010 and an edge of reflector 1005. Offset panels 1025 can be coupled with reflector 1005. In some embodiments, offset panels 1025 can be coupled with reflector 1005 using a plurality of flexible coupling devices (e.g., like those discussed elsewhere) at discrete locations. In some embodiments, offset panels 1025 can be coupled only with reflector 1005 and not with trusses 1010. In other embodiments offset panels 1025 can be coupled with both reflector 1005 and trusses 1010.

In some embodiments, offset panels 1025 can be made of and/or include shape memory polymer (e.g., Tembo®) material. Offset panels, for example 1025 can store membrane strain energy that can help in deployment of deployable reflector system and/or assist in maintaining reflector 1005 in its three dimensional shape.

Figure 9B:
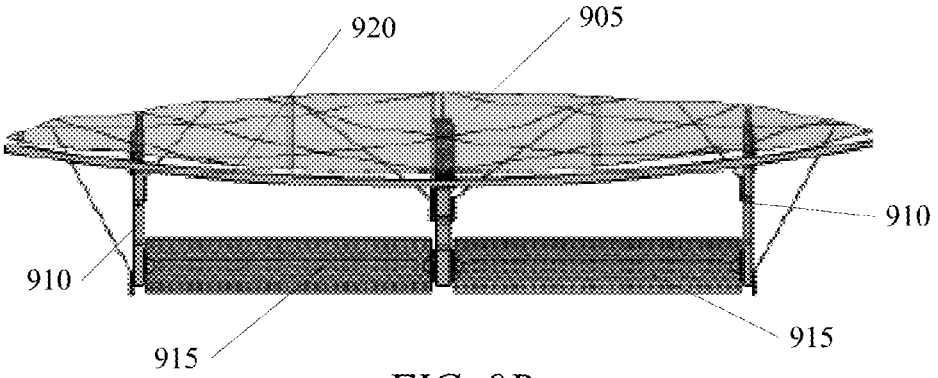
Figure 9C:
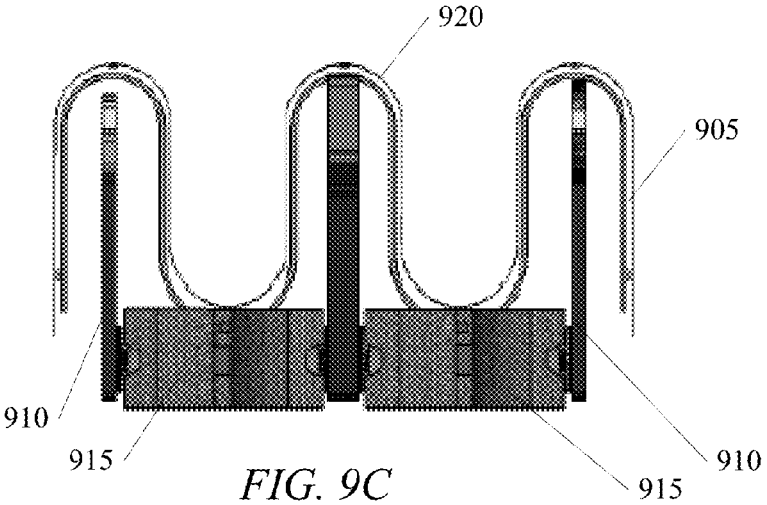

In some embodiments, a reflector can be coupled with a collapsible backing structure. The collapsible backing structure can be similar to the backing structures shown in FIGS. 8-10 and can include any or all of the various components described herein. The reflector can be pleated, folded, hinged, bent, or the like when stowed. For example, the reflector can be hinged at the edges of a collapsible backing structure and/or a fixed backing structure. In some embodiments, a portion of a reflector can be pleated, hinged, folded, or bent and/or other portions of the reflector can remain rigid. Moreover, in some embodiments, a reflector can be hinged, folded, pleated, and/or bent and still remain rigid except where the reflector is hinged, folded, pleated, and/or bent.

Figure 11A:
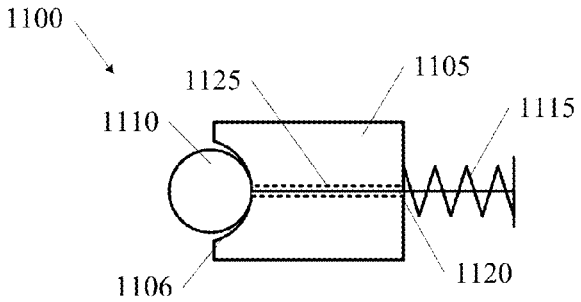
FIGS. 11A, B, C, and D show flexible coupling devices according to some embodiments of the invention.

FIGS. 11A, B, and C, and D show various flexible coupling devices according to some embodiments of the invention. FIG. 11A shows flexible coupling device 1100 in its resting or unflexed state. Flexible coupling device 1100 includes ball 1110 and socket 1106. Spring 1115 is coupled with ball 1110 using wire (or string) 1120 through channel 1125 in socket body 1105. Spring 1115 biases ball 1110 into socket 1106. Wire 1120 can comprise, for example, a polymeric strand (e.g., an aramid), Kevlar, nylon, polypropylene or polyethylene.

Figure 11B:
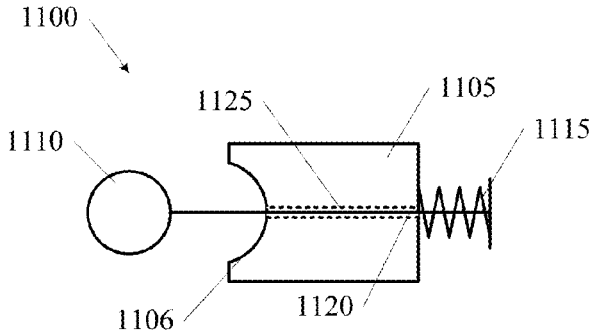
Figure 11C:
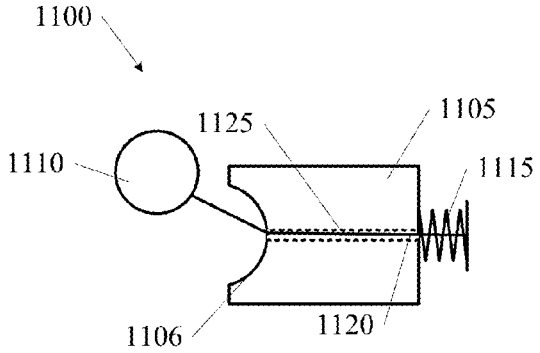

FIG. 11B shows flexible coupling device 1100 in its flexed state. InIn this state, ball 1110 (or cup) is not within socket 1106 (or cone). An external force has been applied to ball 1110 pulling ball 1110 away from socket 1106. BallBall 1110, for example, is in an unlocked position. As shown in the figure, spring 1115 is compressed in the flexed state. The force on ball 1110 must be greater than spring 1115's bias force. FIG. 11C shows how ball 1110 can be pulled away from socket 1106 in most any direction.

Flexible coupling device 1100 can be used to couple two structures (e.g., a reflector and other structures) together yet allow the two structures to move relative to one another when a force greater than the spring's bias force is applied. Spring 1115 can act to pull the two structures together when the external force is less than the bias force provided by spring 1115.

Flexible coupling device 1100 can be used in embodiments of the invention (e.g., embodiments described above in regard to FIGS. 8, 9, and 10) to couple together any two of a reflector, backing structure, truss, stiffener, and/or offset panel. Using flexible coupling device 1100, for example, a reflector can move relative to a backing structure during deployment and/or packaging yet be pulled into position by the bias force of spring 1115. Moreover, in the undeployed state, flexible coupling device 1100 can be in the state shown in FIG. 11B or FIG. 11C. In the deployed state, flexible coupling device 1100 can be in the state shown in FIG. 11A locking the reflector with the backing structure.

Furthermore, in the deployed state, the flexible coupling device may be adjustable in at least one axis such that the deployed shape of the reflector can be manipulated. For example, the cup or cone portions of the device, or both, could be adjusted such that the flexible reflector membrane can assume a desirable shape in the deployed configuration. This adjustability can also be used to remove undesirable distortions, or tune, the flexible reflector membrane to a specific shape.

In some embodiments spring 1115 can apply a force sufficient to pull reflector into position after and/or during deployment.

As shown in the figures, ball 1110 can be separable from socket 1105 in one state (e.g., FIGS. 11B and 11C) and fixed with socket 1105 in another state (e.g., FIG. 11A). That is, flexible coupling device 1100 can provide a fixed or locked coupling between each of two objects (e.g., reflector and backing structure components) separately coupled with ball 1110 and socket 1105 in one state and a loose or unlocked coupling between the objects in another state. While a ball and socket type device is shown, a cup and cone device can be used. Moreover, a tension tie device, a drop tie device, a flat plate friction interface device, etc. can be used. In some embodiments, flexible coupling device 1100 can prevent relative motion between two objects (e.g., a reflector and a backing structure) in the deployed state and allow relative motion between the two objects in the stowed state and during parts of the transition between the two states.

Figure 11D:
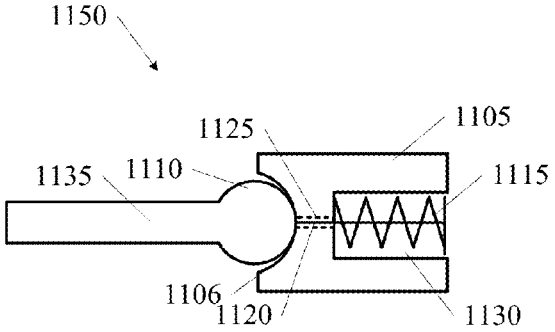

FIG. 11D shows another embodiment of a flexible coupling device 1150. In this embodiment, ball 1110 is coupled with rod 1135. Ball 1110 can be coupled to any type of structure. Also, spring 1115 is disposed within cavity 1130 formed within socket body 1105 to protect the spring from damage. A number of variations of flexible coupling devices are possible.

While the principles of the disclosure have been described above in connection with specific apparatuses and methods, this description is made only by way of example and not as limitation on the scope of the disclosure.

What is claimed is:

1. A reflector comprising:

a reflector having a deployed configuration and a stowed configuration, wherein in the deployed configuration the reflector comprises a three dimensional geometry and in the stowed configuration the reflector comprises a plurality of pleats, wherein the reflector includes a front surface and a back surface;

a stiffener coupled with the back surface of the reflector; and a backing structure coupled with stiffener, the backing structure comprising:

a plurality of rigid panels coupled with the stiffener such that in the stowed configuration each of the plurality of rigid panels is positioned within a valley of one of the reflector surface pleats; and a plurality of crossbeams comprising a shape memory material and disposed between two of the plurality of rigid panels, wherein the plurality of cross beams form pleats in the stowed configuration.

2. The reflector according to claim 1, wherein the stiffener comprises a plurality of stiffeners.

3. The reflector according to claim 1, wherein the stiffener is not integral with the reflector.

4. The reflector according to claim 1, wherein the backing structure comprises a plurality of trusses and the stiffener extends across a horizontal portion of the reflector in a substantially perpendicular orientation relative to the trusses.

5. The reflector according to claim 1, wherein the stiffener is coupled with the back surface of the reflector at a plurality of discrete locations.

6. The reflector according to claim 1, wherein the stiffener comprises a shape memory polymer.

7. The reflector according to claim 1, wherein the stiffener comprises a plurality of stiffeners coupled with the back surface of the reflector and the backing structure.

8. A deployable reflector system with a backing structure comprising:

a reflector having a deployed configuration and a stowed configuration, wherein in the deployed configuration the reflector comprises a shape, and in the stowed configuration the reflector comprises a plurality of pleats, wherein the reflector includes a front surface and a back surface;

a plurality of stiffeners coupled with the back surface of the reflector; and a backing structure comprising:

a plurality of trusses, wherein at least one of the plurality of trusses is coupled with at least one of the plurality of stiffeners;

a plurality of rigid panels coupled with the plurality of stiffeners such that in the stowed configuration each of the plurality of rigid panels is positioned within a valley of one of the reflector surface pleats; and a plurality of crossbeams comprising a shape memory material disposed between two of the plurality of rigid panels, wherein the plurality of cross beams form pleats in the stowed configuration.

9. The deployable reflector system according to claim 8, wherein the plurality of stiffeners are not integral with the reflector.

10. The deployable reflector system according to claim 8, wherein the plurality of stiffeners extends across a horizontal portion of the reflector in a substantially perpendicular orientation relative to the plurality of trusses.

11. The deployable reflector system according to claim 8, wherein the plurality of stiffeners are coupled with the back surface of the reflector at a plurality of discrete locations.

12. The deployable reflector system according to claim 8, wherein the plurality of stiffeners comprises a shape memory polymer.

* * * * *